US009593661B2

(12) United States Patent
Hubert et al.

(10) Patent No.: US 9,593,661 B2
(45) Date of Patent: Mar. 14, 2017

(54) PREHEATER ASSEMBLY, A CYLINDER HEAD, A PISTON ENGINE, AND AN AIRCRAFT

(71) Applicant: AIRBUS HELICOPTERS, Marignane (FR)

(72) Inventors: Pierre-Julien Hubert, Igny (FR); Romain Clair, Le Pecq (FR); Christian Mercier, La Fare les Oliviers (FR)

(73) Assignee: AIRBUS HELICOPTERS, Marignane (FR)

( * ) Notice: Subject to any disclaimer, the term of this patent is extended or adjusted under 35 U.S.C. 154(b) by 80 days.

(21) Appl. No.: 14/794,053

(22) Filed: Jul. 8, 2015

(65) Prior Publication Data

US 2016/0010617 A1 Jan. 14, 2016

(30) Foreign Application Priority Data

Jul. 9, 2014 (FR) ..... 14 01536

(51) Int. Cl.
*F02P 19/02* (2006.01)
*F02F 1/42* (2006.01)
*F23Q 7/00* (2006.01)

(52) U.S. Cl.
CPC ..... *F02P 19/02* (2013.01); *F02F 1/42* (2013.01); *F23Q 7/001* (2013.01); *F23Q 2007/004* (2013.01)

(58) Field of Classification Search
CPC ..... F02P 19/02; F02F 1/42; F02F 1/24; F02F 1/242; F23Q 7/001; F23Q 2007/004; F16J 10/00; F16J 10/02
USPC ..... 123/193.3, 193.5, 543, 549, 550, 557, 123/558, 179.6, 145 A, 145 R
See application file for complete search history.

(56) References Cited

U.S. PATENT DOCUMENTS 6,539,787 B1 * 4/2003 Murai ..... F02D 35/023 73/114.21
7,115,836 B2 * 10/2006 Yoshikawa ..... F23Q 7/001 219/270
2008/0264373 A1 * 10/2008 Boehland ..... F23Q 7/001 123/145 A

FOREIGN PATENT DOCUMENTS

| | | |
|---|---|---|
| BE | 402977 | 6/1934 |
| DE | 3928105 | 3/1990 |
| FR | 1133786 | 4/1957 |
| FR | 2894724 | 6/2007 |

(Continued)

OTHER PUBLICATIONS

French Search Report for French Application No. 1401536, Completed by the French Patent Office on Feb. 26, 2015, 6 Pages.

*Primary Examiner* — Grant Moubry
(74) *Attorney, Agent, or Firm* — Brooks Kushman P.C.

(57) ABSTRACT

A preheater assembly of a glowplug and a hollow sheath extending longitudinally from a bottom external zone to a top external zone, the sheath extending radially from an inside surface defining a cavity towards an outside surface, the glowplug being inserted in the cavity, the tip projecting from the sheath through the bottom external zone, the inside surface of the sheath presenting a second thread meshing with a first thread of the glowplug, the inside surface of the sheath presenting a first conical seat bearing against the first conical bearing surface of the glowplug, the outside surface of the bottom external zone having a third thread screwed into a cylinder head and a second bearing surface that bears against the second seat of a cylinder head.

12 Claims, 2 Drawing Sheets

(56) References Cited

FOREIGN PATENT DOCUMENTS

| | | | | |
|---|---|---|---|---|
| FR | 2948420 A1 * | 1/2011 | ..... | F02M 31/135 |
| FR | 2998949 | 6/2014 | | |

* cited by examiner

PREHEATER ASSEMBLY, A CYLINDER HEAD, A PISTON ENGINE, AND AN AIRCRAFT

CROSS REFERENCE TO RELATED APPLICATION

This application claims priority to French patent application No. FR 14 01536 filed on Jul. 9, 2014, the disclosure of which is incorporated in its entirety by reference herein.

BACKGROUND OF THE INVENTION (1) Field of the Invention

The present invention relates to a preheater assembly, to a cylinder head fitted with the assembly, to a piston engine fitted with such a cylinder head, and to an aircraft.

The invention thus lies in the narrow technical field of preheater devices for a piston engine, and in particular a diesel engine. More particularly, the invention is situated in the technical field of aircraft having a piston engine with compression ignition.

(2) Description of Related Art

In particular, an aircraft may have at least one rotor for providing it with at least part of its lift and/or its propulsion. The rotor is then driven in rotation by a power plant comprising at least one engine. The engine may be a piston engine.

A piston engine usually comprises an engine block with one cylinder per piston, each piston sliding in a respective cylinder. Each cylinder is then closed by a cylinder head.

Furthermore, the operation of a diesel engine relies on self-ignition of a fuel in a combustion chamber filled with compressed air at a high temperature. Consequently, the air must reach a minimum temperature at the end of compression in order to cause the fuel to ignite.

Unfortunately, this minimum temperature can be difficult to reach when the engine is cold.

Consequently, a diesel engine may include a preheater system.

Heater systems using water seek to heat the entire engine.

Such systems are advantageous, but arranging them in an aircraft is difficult.

Other heater systems seek to heat the gas prior to admitting it into a combustion chamber.

Another system consists in using one glowplug per cylinder.

A glowplug comprises in succession: a connection terminal; a body; and then a heater tip. A heater filament is included in the tip and is connected to the connection terminal.

Under such circumstances, the glowplug passes through the cylinder head in order to lead into the combustion chamber. The body of the glowplug thus possesses a thread that is screwed into a thread of the cylinder head. The body also has a conical bearing surface that becomes pressed against a conical seat in the cylinder head in order to guarantee that the assembly is leaktight.

Under such circumstances, the heater tip is advantageously positioned at least in part in the combustion chamber so as to have the stream of fuel that is injected into the combustion chamber impact thereagainst.

An electric current is then applied to the connection terminal in order to heat the tip of the glowplug by means of the heater filament. The tip creates a hot point in the combustion chamber that enables the mixture of air and fuel to ignite. Consequently, the glowplug enables a diesel piston engine to be started when cold.

The use of a glowplug avoids arranging a heater system that is complex and bulky.

Nevertheless, a cylinder head is also provided with admission and exhaust valves and with fuel injectors.

Consequently, the space available for arranging a glowplug can be restricted.

The positioning of the thread of a given glowplug can make it difficult to arrange in a cylinder head.

Consequently, arranging an existing glowplug on a new cylinder head can turn out to be difficult.

A manufacturer can then envisage developing a new glowplug adapted to the new cylinder head. Nevertheless, developing a new glowplug is particularly expensive. Such development is even more expensive for an aircraft insofar as an aircraft and in particular rotorcraft are generally manufactured in numbers that are small, e.g. in comparison with the numbers of cars that are produced.

Consequently, an aircraft manufacturer tends to envisage making use of other heater systems.

An object of the present invention is to go against that prejudice by proposing an alternative preheater assembly.

In particular, the invention relates to a preheater assembly for an aircraft piston engine, where arranging such a piston engine on an aircraft gives rise to specific difficulties.

Documents FR 2 998 949, DE 39 28 105, FR 1 133 786, BE 402 977, and FR 2 894 724 are known.

BRIEF SUMMARY OF THE INVENTION

According to the invention, a preheater assembly is for a cylinder head of a piston engine, the preheater assembly being provided with a glowplug comprising in succession a connection terminal followed by a body and a heater tip, the body presenting a bottom end forming a first conical bearing surface and a top end having a first thread.

The preheater assembly comprises a hollow sheath extending longitudinally from a bottom external zone to a top external zone, said sheath extending radially from an inside surface defining a cavity towards an outside surface, said glowplug being inserted in said cavity, said tip projecting from said sheath through the bottom external zone, the inside surface of the sheath presenting a second thread in the top external zone meshing with the first thread of the glowplug, the inside surface of the sheath presenting a first conical seat in the bottom external zone bearing against the first conical bearing surface of the glowplug, the outside surface of the bottom external zone having a third thread suitable for being screwed into a fourth thread of a cylinder head and a second bearing surface that is to bear against the second seat of a cylinder head.

The preheater assembly thus comprises a glowplug and a sheath, it being possible for the glowplug to be a conventional glowplug that is commercially available.

In some of the state of the art, a glowplug is arranged directly in a cylinder head. Such a simple arrangement of a glowplug can turn out to be difficult or even impossible. The state of the art thus tends to encourage the person skilled in the art either to use a heater system of some other type, or to develop a new glowplug.

The invention goes against that prejudice by making use of a sheath in which the glowplug is inserted.

Under such circumstances, the sheath has a thread referred to as a "second thread" that enables the glowplug to be screwed into the sheath. Causing the conical bearing surface of the glowplug referred to as the "first conical bearing surface" to bear against an internal conical seat of the sheath referred to as the "first conical seat", then ensures leaktightness within the sheath.

A manufacturer then adapts the position of the second thread and of the first conical seat to the shape of the glowplug that is to be used. The glowplug can be a conventional glowplug having a metal body and a heater tip made of metal or of ceramic.

In addition, the sheath is screwed to the bottom portion of the cylinder head on its side closest to the combustion chamber by means of a thread of the sheath referred to as the "third thread". In addition, the sheath has a conical bearing surface for providing leaktight sealing between the cylinder head and the preheater assembly.

Consequently, the preheater assembly forms a leaktight assembly guaranteeing leaktightness against combustion gas coming from the combustion chamber that receives the glowplug.

The preheater assembly then constitutes an assembly that is relatively simple and of weight that is low compared with preheater systems that do not have a glowplug.

Furthermore, the assembly enables a glowplug to be arranged in a cylinder head not designed for that purpose.

In particular, a cylinder head of a new type comprises a bottom plate for closing at least one cylinder. The cylinder head also has a top portion that is fastened on top of the bottom plate.

Such a cylinder head makes it possible to use a bottom plate that is made of a material that presents very good resistance to high temperatures together with a top portion that is of reduced weight.

Installing a standard glowplug passing through two different materials then requires awkward sealing problems to be resolved, and those problems are resolved by the preheater assembly of the invention.

In addition, a standard glowplug may not be capable of being mounted directly in a bottom plate, since it is of relatively small thickness.

Using a sheath in accordance with the invention serves to solve this new problem. Such use is not obvious in any way since it leads to a small additional dead volume being created that is in fluid flow communication with the combustion chamber. Nevertheless, and going against existing prejudices, the Applicant has found that the improvements provided by the invention are prevail over the drawbacks generated by such a dead volume.

The preheater assembly may also include one or more of the following additional characteristics.

For example, the assembly comprises in succession in a longitudinal direction:

a point of the tip;

the third thread arranged on the outside surface of the bottom external zone of the sheath;

the second bearing surface of the outside surface of the bottom external zone of the sheath;

the first conical seat of the inside surface of the bottom external zone of the sheath;

the first conical bearing surface of the glowplug bearing against the first conical seat; and the second thread of the inside surface of the top external zone of the sheath engaged with the first thread of the glowplug.

Furthermore, the sheath may be made of steel in order to provide good temperature lagging and good mechanical strength.

In another aspect, the sheath and/or the glowplug include a lock wire for good fastening.

The mounting of the glowplug or of the sheath can thus be locked by a device of the lock wire type or equivalent.

Furthermore, the top external zone of the sheath may include tightening means. Such tightening means may comprise a hexagonal head, for example.

In addition to a preheater assembly, the invention provides a cylinder head for covering at least one cylinder in a piston engine.

The cylinder head comprises a bottom plate for covering at least one cylinder of the engine and a top layer resting on the bottom plate. The cylinder head has at least one preheater assembly of the type described above, the bottom plate having a bottom through orifice for opening out into a combustion chamber and said top layer having a top through orifice opening to a medium outside the cylinder head and to the bottom through orifice. The sheath is inserted in the bottom through orifice and the top through orifice, the sheath being screwed into the bottom plate, the third thread of the sheath being screwed into a fourth thread of the bottom plate and the second conical bearing surface of the sheath bearing against a second seat of the bottom plate, the tip projection from the cylinder head via the bottom through orifice of said bottom plate.

The bottom through orifice of the cylinder head is said to be "through" insofar as this orifice passes through the thickness of the bottom plate.

The state of the art includes a conventional cylinder head having a glowplug mounted directly in the cylinder head.

Such a glowplug would appear not to be suitable for being mounted in a cylinder head having a bottom plate of small thickness surmounted by a top layer. The top layer may in particular be made of a material that presents low weight, that conducts heat, and that is suitable for being fabricated at lower cost, such as an aluminum alloy. The bottom plate may comprise a material that is damaged little at high temperature, such as steel.

Such a commercially available glowplug would be fastened in the top layer of the cylinder head given the position of its thread. Such an arrangement is found to be impossible for reasons of leakage, and also for reasons of mechanical strength given the mechanical characteristics of the top layer.

The invention makes it possible to remedy that problem by proposing a sheath that can be anchored in the bottom plate. Sealing between the preheater assembly and the cylinder head is provided in the bottom plate, thereby avoiding any problem of gas leaking between the bottom plate and the top layer.

Furthermore, the cylinder head may have an O-ring arranged between the bottom plate and the top layer, the O-ring being arranged around the sheath.

An O-ring may then be placed around the sheath, at the interface between the bottom plate and the top layer of the cylinder head. The O-ring serves to isolate the bottom through orifice and the top through orifice, e.g. from water chambers. The O-ring thus serves to avoid water leaking into the combustion chambers.

Furthermore, the cylinder head may present clearance separating the top layer from the sheath.

The sheath passes through the top layer of the cylinder head without it being necessary to use sealing means, since sealing is provided in the bottom plate.

Furthermore, the sheath is not in contact with the top layer because of the presence of clearance enabling the sheath and/or the top layer to expand.

This clearance also serves to limit the transfer of heat from the glowplug to the top layer.

Furthermore, the cylinder head has at least one air admission port for conveying air to a combustion chamber and at least one gas exhaust port for expelling gas from the combustion chamber, and the preheater assembly is closer to the air admission port than to the gas exhaust port.

The sheath and the glowplug are preferably installed beside the admission ports of the cylinder head, since this side is the cooler side of the cylinder head.

In addition to a cylinder head, the invention provides a piston engine having an engine block housing at least one cylinder. The engine then has at least one cylinder head of the above-described type.

Finally, the invention provides an aircraft having such an engine.

BRIEF DESCRIPTION OF THE SEVERAL VIEWS OF THE DRAWINGS

The invention and its advantages appear in greater detail from the context of the following description of examples given by way of illustration and with reference to the accompanying figures, in which.

Elements present in more than one of the figures are given the same references in each of them.

DETAILED DESCRIPTION OF THE INVENTION

Figure 1:
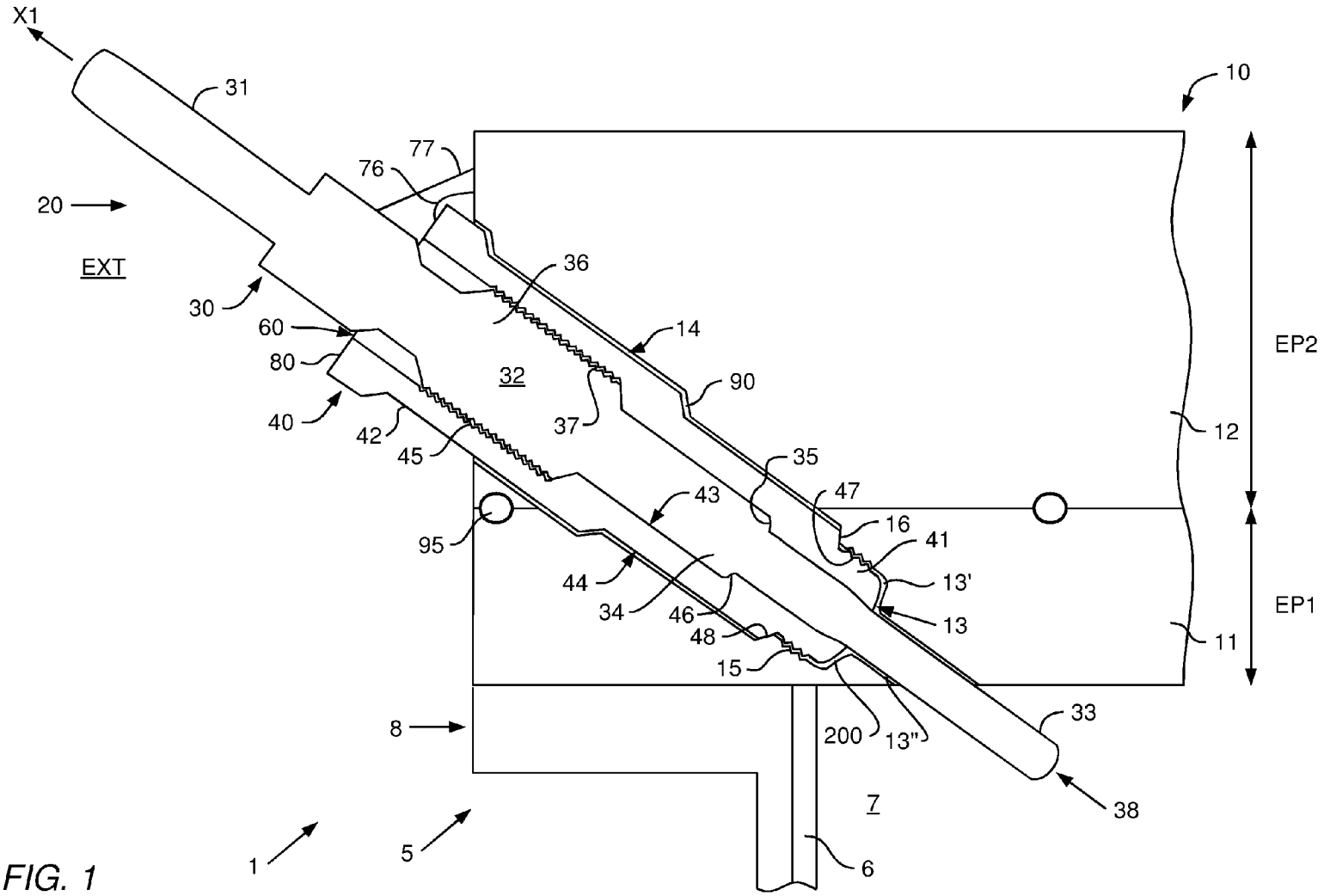
FIG. 1 is a view showing a preheater assembly arranged in an engine cylinder head.

FIG. 1 is a local section through an engine 5 of an aircraft 1.

The engine 5 is a piston engine having an engine block 8. At least one cylinder 6 defines a combustion chamber 7 within the engine block 8.

Furthermore, the engine 5 has at least one cylinder head 10 for closing at least one cylinder 6. In conventional manner, the cylinder head 10 has air admission and gas exhaust ports that are not visible in FIG. 1. These air admission and gas exhaust ports are in fluid flow communication with the combustion chamber 7.

The cylinder head is also provided with a bottom plate 11 resting on a cylinder 6 in order to close the combustion chamber 7. The cylinder head also has a top layer 12 that rests on the bottom plate.

The bottom plate 11 may have a thickness EP1 that is smaller than the thickness EP2 of the top layer. By way of example, the bottom plate 11 has thickness of centimeter order.

In addition, the bottom plate 11 may be made of a material that is different from the material constituting the top layer. Furthermore, the cylinder head may include one preheater assembly 20 per cylinder that is covered in order to create a hot point in the combustion chamber 7.

The preheater assembly 20 comprises a glowplug 30 and a sheath 40.

The glowplug 30 is a conventional glowplug having a connection terminal 31, a body 32, and a tip 33. A heater filament extends for example in the tip 33 in order to heat the tip 33 and in particular the point 38 of the tip 33.

The body 32 may be made up of a bottom end 34 situated in line with the tip 33 and a top end 36 extended by the connection terminal.

Under such circumstances, the glowplug presents in succession in a longitudinal direction X1 going from the combustion chamber 7 to an outside medium EXT situated outside the engine: the tip 33; the bottom end 34 of the body; the top end 36 of the body; and the connection terminal.

In addition, the bottom end 34 of the body presents a conical bearing surface. This conical bearing surface is referred to as the "first conical bearing surface 35" in order to be identified individually. For example, this first conical bearing surface 35 is positioned at the interface between the body 32 and the tip.

Furthermore, the top end 36 of the body presents a thread. This thread is referred to as the "first thread 37" in order to be identified individually. The first thread 37 is thus downstream from the first conical bearing surface with reference to the longitudinal direction X1.

The end of the body carrying the first conical bearing surface is thus referred to as the "bottom" end, and the end of the body carrying the first thread is referred to as the "top" end.

This configuration of the glowplug does not enable it to be anchored in the bottom plate 11.

Under such circumstances, the preheater assembly comprises a hollow sheath 40. This sheath 40 is interposed between the glowplug 30 and the cylinder head 10. The glowplug 30 is screwed into the sheath 40, with the sheath 40 being screwed into the cylinder head 10.

For this purpose, the sheath is provided with a shell extending in the longitudinal direction X1 from a bottom external zone 41 towards a top external zone 42.

The term "bottom external zone 41" is used to designate the segment of the sheath that extends inside the bottom plate 11, and the term "top external zone 42" is used to designate the segment of the sheath that extends in the top layer 12 of the cylinder head.

Furthermore, the shell of the sheath 40 extends radially from an inside surface 43 defining a cavity 60 towards an outside surface 44 that faces the walls of the cylinder head.

Under such circumstances, the inside surface 43 of the sheath 40 has a thread in the top external zone 42. This thread is referred to as the "second thread 45" in order to be identified individually.

This inside surface 43 of the sheath 40 also has a first conical seat 46 in the bottom external zone 41.

The first conical seat 46 is upstream from the second thread 45 relative to the longitudinal direction X1.

In addition, the outside surface 44 of the sheath presents a thread at the bottom external zone 41 of the sheath. This thread is referred to as the "third thread 47" in order to be individually identified.

Furthermore, the outside surface 44 has a conical bearing surface in the bottom external zone 41. This conical bearing surface is referred to as the "second conical bearing surface 48" in order to be individually identified.

Consequently, an operator can insert the glowplug 30 into the cavity 60 of the sheath. The operator thus screws the glowplug 30 into the sheath 40, the first thread 37 then engaging with the second thread 45.

At the end of this screw fastening operation, the first conical bearing surface 35 of the glowplug bears in leaktight manner against the first conical seat 46 of the sheath.

Furthermore, the tip 33 of the glowplug projects in part from the sheath 40.

Under such circumstances, the operator screws the sheath into the cylinder head. In an alternative method, the operator can begin by screwing the sheath into the cylinder head and then screw the glowplug into the sheath.

In order to make the sheath easier to screw into position, the top external zone 42 of the sheath advantageously includes tightening means 80.

In addition, the cylinder head has a bottom through orifice 13 passing through the bottom plate 11. This bottom through orifice 13 may comprise a first portion 13' presenting a large section in order to receive the sheath 40 and a second portion 13" presenting a narrow section so as to have only the tip 33 passing therethrough.

Furthermore, the cylinder head has a top through orifice 14 passing through the top layer 12.

Consequently, the top through orifice 12 opens out firstly into the outside medium EXT and secondly into the bottom through orifice 13, the bottom through orifice 13 itself opening out into the combustion chamber 7.

Consequently, the sheath 40 passes entirely through the top through orifice 12 in order to be screwed into the bottom plate 11. The third thread 47 of the sheath 40 is screwed to the fourth thread 15 of the bottom plate 11. In addition, the second conical bearing surface 48 of the sheath 40 bears against the second seat 16 of the bottom plate 11.

The tip 33 then projects from the cylinder head 10 via the bottom through orifice 13 of said bottom plate 11.

Along the longitudinal direction X1, the preheater assembly 20 comprises in succession:

the point 38 of the tip 33;

the third thread 47 arranged on the outside surface 44 of the bottom external zone 41 of the sheath 40;

the second bearing surface 48 of the outside surface 44 of the bottom external zone 41 of the sheath 40;

the first conical seat 46 of the inside surface 43 of the bottom external zone 41 of the sheath 40;

the first conical bearing surface 35 of the glowplug 30 bearing against the first conical seat 46; and the second thread 45 of the inside surface 43 of the top external zone 42 of the sheath 40 engaged with the first thread 37 of the glowplug 30.

The preheater assembly may also include at least one lock wire for holding the glowplug 30 and/or the sheath in position.

For example, a lock wire 76 serves to fasten the top external zone 42 of the sheath to the cylinder head and/or a lock wire 77 serves to fasten the glowplug to the cylinder head. Other means equivalent to the lock wire could be used, such as a "thread lock adhesive".

Furthermore, the cylinder head has expansion clearance referred to more simply as "clearance 90" between the top layer 12 of the cylinder head and the sheath 40.

Likewise, the arrangement of a sheath leads to the presence of dead space 200 in the bottom through orifice in fluid flow communication with the combustion chamber 7. This dead space is then localized in the first portion 13' of the bottom through orifice, lying between the end of the sheath and the second portion 13" of the bottom through orifice.

In addition, the cylinder head 10 then includes an O-ring 95. This O-ring 95 is arranged between the bottom plate 11 and the top layer 12. In addition, this O-ring 95 is arranged around the sheath 40.

Figure 2:
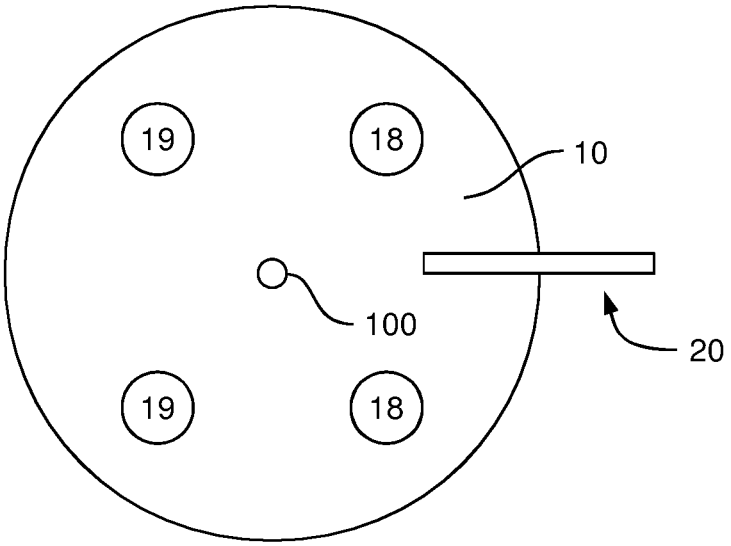
FIG. 2 is a diagram explaining how the preheater assembly is placed relative to the air admission and gas exhaust ports.

With reference to FIG. 2, the cylinder head may define at least one air admission port 18 for conveying air to the combustion chamber 7, and at least one gas exhaust port 19 for expelling gas from the combustion chamber 7 after combustion. The cylinder head may also receive an injector 100.

Under such circumstances, the preheater assembly 20 is advantageously closer to the air admission port 18 than it is to the gas exhaust port 19.

Naturally, the present invention may be subjected to numerous variations as to its implementation. It will readily be understood that it is not conceivable to identify exhaustively all possible embodiments. It is naturally possible to envisage replacing any of the means described by equivalent means without going beyond the ambit of the present invention.

What is claimed is:

1. A preheater assembly for a cylinder head of a piston engine, the preheater assembly being provided with a glowplug comprising in succession a connection terminal followed by a body and a heater tip, the body presenting a bottom end forming a first conical bearing surface and a top end having a first thread, wherein the preheater assembly includes a hollow sheath extending longitudinally from a bottom external zone to a top external zone, the sheath extending radially from an inside surface defining a cavity towards an outside surface, the glowplug being inserted in the cavity, the tip projecting from the sheath through the bottom external zone, the inside surface of the sheath presenting a second thread in the top external zone meshing with the first thread of the glowplug, the inside surface of the sheath presenting a first conical seat in the bottom external zone bearing against the first conical bearing surface of the glowplug, the outside surface of the bottom external zone having a third thread suitable for being screwed into a fourth thread of the cylinder head and a second bearing surface that is to bear against a second seat of the cylinder head.

2. The assembly according to claim 1, wherein the assembly comprises in succession in a longitudinal direction:

a point of the tip;

the third thread arranged on the outside surface of the bottom external zone of the sheath;

the second bearing surface of the outside surface of the bottom external zone of the sheath;

the first conical seat of the inside surface of the bottom external zone of the sheath;

the first conical bearing surface of the glowplug bearing against the first conical seat; and the second thread of the inside surface of the top external zone of the sheath engaged with the first thread of the glowplug.

3. The assembly according to claim 1, wherein the sheath is made of steel.

4. The assembly according to claim 1, wherein the sheath includes a lock wire.

5. The assembly according to claim 1, wherein the glowplug includes a lock wire.

6. The assembly according to claim 1, wherein the top external zone of the sheath includes tightening means.

7. A cylinder head for covering at least one cylinder of a piston engine, wherein the cylinder head comprises a bottom plate for covering at least one cylinder of the engine and a top layer resting on the bottom plate, the cylinder head having at least one preheater assembly according to claim 1, the bottom plate having a bottom through orifice for opening out into a combustion chamber and the top layer having a top through orifice opening to a medium (EXT) outside the cylinder head and to the bottom through orifice, the sheath being inserted in the bottom through orifice and the top through orifice, the sheath being screwed into the bottom plate, the third thread of the sheath being screwed into a fourth thread of the bottom plate and the second conical bearing surface of the sheath bearing against a second seat of the bottom plate, the tip projecting from the cylinder head via the bottom through orifice of the bottom plate.

8. The cylinder head according to claim 7, wherein the cylinder head presents clearance separating the top layer from the sheath.

9. The cylinder head according to claim 7, wherein the cylinder head has an O-ring arranged between the bottom plate and the top layer, the O-ring being arranged around the sheath.

10. The cylinder head according to claim 7, wherein the cylinder head has at least one air admission port for conveying air to a combustion chamber and at least one gas exhaust port for expelling gas from the combustion chamber, and the preheater assembly is closer to the air admission port than to the gas exhaust port.

11. A piston engine having an engine block housing at least one cylinder and wherein the engine includes at least one cylinder head according to claim 7 in order to cover at least one cylinder.

12. An aircraft, wherein the aircraft includes at least one engine according to claim 11.

* * * * *